US006153065A

United States Patent [19]

Yamamoto

[11] Patent Number: 6,153,065

[45] Date of Patent: Nov. 28, 2000

[54] INTERNAL STRESS TESTING DEVICE FOR HIGH SPEED ELECTROPLATING

[75] Inventor: Wataru Yamamoto, Tokyo, Japan

[73] Assignee: Yamamoto-MS Co., Ltd., Tokyo, Japan

[21] Appl. No.: 09/332,910

[22] Filed: Jun. 15, 1999

[30] Foreign Application Priority Data

Jun. 15, 1998 [JP] Japan ..... 10-166909

[51] Int. Cl.[7] ..... C25D 17/00

[52] U.S. Cl. ..... 204/212; 204/242; 204/272; 204/273; 204/278.5; 204/218; 204/224 R; 204/228.1; 204/228.7; 204/434

[58] Field of Search ..... 204/242, 272, 204/273, 278.5, 434, 212, 218, 224 R, 228.1, 228.7; 73/53.06, 54.33, 54.27, 54.28, 54.29, 61.62

[56] References Cited

U.S. PATENT DOCUMENTS 4,086,154 4/1978 Hicks ..... 204/434
4,647,365 3/1987 Irlesberger et al. ..... 204/434
4,648,944 3/1987 George et al. ..... 204/434
4,786,376 11/1988 Vaaler ..... 204/231
5,698,085 12/1997 Yu ..... 204/434
6,017,427 1/2000 Yamamoto ..... 204/212

*Primary Examiner*—Bruce F. Bell
*Attorney, Agent, or Firm*—Liniak, Berenato, Longacre & White

[57] ABSTRACT

An internal stress testing device for high speed electroplating is disclosed. The testing device comprises: a tank to be filled with a plating solution; a metal plate for anode disposed within the tank; a metal rod for cathode disposed within the tank and rotatably held by a motor at a position opposite to the metal plate for anode; a metal plate for cathode in the shape of a thin plate mounted on the metal rod; and a DC power supply connected to the metal plate for anode and the metal rod for cathode.

5 Claims, 6 Drawing Sheets

INTERNAL STRESS TESTING DEVICE FOR HIGH SPEED ELECTROPLATING

BACKGROUND OF THE INVENTION

1. Field of the Invention

The present invention relates to an internal stress testing device for testing internal stress generated upon high speed electroplating.

2. Prior Art

Plating technology is widely used in various fields of our daily life. Particularly, in the electronics industry, high speed electroplating has been widely known for plating on lead frames of semiconductors such as integrated circuits.

High speed electroplating is carried out either by moving a plating solution at high speed under high current density or by splaying the plating solution at high speed. Such method ensures approximately a hundred times faster plating velocity compared with the conventional known plating method.

In this high speed electroplating method, various conditions for electrodeposition are required such as suitable plating bath composition, current density, agitation speed and the like. These conditions are kept optimal at the beginning, however, composition of the plating bath tends to change gradually due to its repeated use. Also, predicted and unexpected impurities are mixed into the plating bath. Plated films (plating deposits) to be made are affected by the change of the plating bath, and hence leading to deteriorated plated film quality in the end.

The optimal composition of the plating bath and the optimal conditions for electrodeposition are required so as to obtain the best plated films constantly. According to the change of the plating bath, addition of chemicals, removal of impurities, or adjustment of the various conditions such as current density is required as well as predicting the change in the plating bath composition. To this end, it is necessary to well understand the conditions of a fresh plating solution and the plating solution now in use.

Various factors should be considered for the optimal conditions of the plating bath. Measurement of internal stress of a plating deposit is one of the most important factors. An internal stress testing device utilizing a spiral contractometer is known as a testing device which can create similar plating conditions of the high speed electroplating method.

As shown in FIG. 6, an internal stress testing device 50 utilizing a spiral contractometer comprises a spiral-shaped test piece 51 fixed to a rotational axis 52 by attachment clamps 53, 54, a metal plate 55 for anode, and a plating tank filled with a plating solution. The test piece 51 and the metal plate 55 for anode are positioned within the plating tank, and they are connected to a power supply (not shown). When an electric current flows between the test piece 51 and the metal plate 55 for anode, a plating deposit is made on the surface of the test piece 51 and internal stress is generated at the plating deposit on the test piece 51. The test piece 51 is then rotated due to the internal stress thus generated. The internal stress at the plated film is measured by converting the rotation into the angle of torsion (θ) with the use of a transducer 56.

Internal stress (σ) of a plated film is given by the following formula (1):

$$\sigma = \frac{2k}{pt} \cdot \frac{\alpha}{d}$$

where, K: Spiral constant (mm N/deg),

α: Angle of torsion (deg), p: Spiral pitch (mm), t: Thickness of the spiral plate (mm)

d: Thickness of the plating deposit (mm)

SUMMARY OF THE INVENTION

However, in this internal stress testing device 50 utilizing a spiral contractometer, the test piece 51 as an object to be plated is either stationary or moved by relative movement of the plating solution. In the latter case, the plating solution is relatively moved to the test piece 51 by an agitating device (not shown). In such testing device, since internal stress of the plating deposit is tested at low velocities such as of 5 m/min at most, a few ampere electric currents, and a few minutes plating operations, it can not be used for hoop plating that is a popular plating method in recent years for electronic parts, and high speed electroplating that is used for continuously and at high speed plating electric wires produced in the iron industry and electric wire makers. In the high speed electroplatingmethod, an object to be plated is moved at 120 m/min at maximum and plated instantaneously at high electric currents more than 10 amperes, which requires a larger testing equipment to provide similar operating conditions. There is a drawback in that the conventional small and simple testing device can not provide these conditions.

With the foregoing drawback of the prior art in view, the present invention seeks to provide an internal stress testing device for high speed electroplating which utilizes a testing device in a small and relatively simple construction.

According to the present invention, there is provided an internal stress testing device for high speed electroplating, which comprises: a tank to be filled with a plating solution; a metal plate for anode disposed within the tank; a metal rod for cathode disposed within the tank and rotatably held by a motor at a position opposite to the metal plate for anode; a metal plate for cathode in the shape of a thin plate mounted on the metal rod; and a DC power supply connected to the metal plate for anode and the metal rod for cathode.

Another object of the present invention is to provide an internal stress testing device for high speed electroplating as mentioned above, wherein the tank has a square transverse section, and the metal plate for anode and the metal rod for cathode are disposed in pair.

Further object of the present invention is to provide an internal stress testing device for high speed electroplating as mentioned above, wherein the tank has a square transverse section, and a plurality of metal plates for anode are disposed symmetrically around the metal rod for cathode.

Still further object of the present invention is to provide an internal stress testing device for high speed electroplating as mentioned above, wherein the tank has a circular transverse section, and the metal plate for anode extends along the inner periphery of the tank.

Another object of the present invention is to provide an internal stress testing device for high speed electroplating as mentioned above, wherein the metal plate for cathode is mounted on the plane surface at the lower end of the metal rod for cathode.

Other objects and features of the present invention will become apparent by reference to the following detailed description taken in conjunction with the accompanying drawings.

DESCRIPTION OF THE PREFERRED EMBODIMENT

Figure 1:
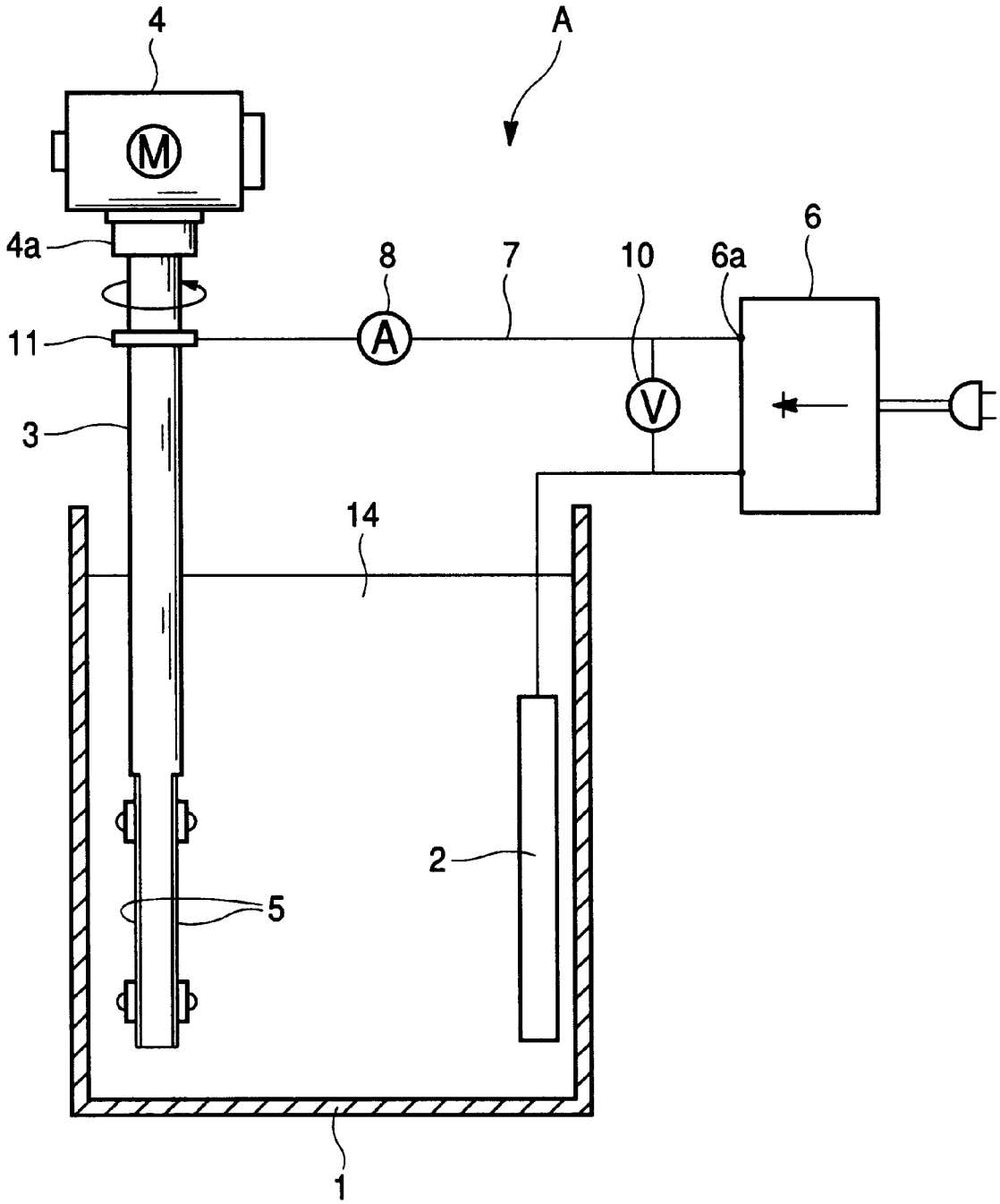
FIG. 1 is an explanatory view showing the construction of an internal stress testing device for high speed electroplating according to the present invention.

Referring now to FIG. 1, an internal stress testing device A for high speed electroplating mainly comprises a plating tank 1 to be filled with a plating solution, a metal plate 2 for anode disposed within the tank 1, a metal rod 3 for cathode disposed within the tank 1 and rotatably held by a motor 4 at a position opposite to the metal plate 2 for anode, two opposite metal plates 5, 5 for cathode mounted on the metal rod 3, a rectifier 6 as a DC power supply connected to the metal plate 2 for anode and the metal rod 3 for cathode.

The metal rod 3 for cathode is connected to the negative terminal 6*a* of the rectifier 6 through an electric lead 7, and an ammeter 8 is connected to the electric lead 7 between the metal rod 3 and the rectifier 6 for measuring an electric current during the plating operation. Also, the metal plate 2 for anode is connected to the positive terminal 6*b* of the rectifier 6 through an electric lead 9. A voltage indicator 10 is provided between the electric leads 7, 9 for measuring an electric voltage applied to the high speed electroplating testing device A.

The plating tank 1 provided with the testing device A is made of a synthetic resin such as acrylic resin, polypropylene, Teflon or the like so as to prevent the corrosion due to the plating solution. The plating tank 1 has a box-like outer profile, 100 mm length, 70 mm width, and 150 mm height.

Depending on the plating, the metal plate 2 for anode disposed within the plating tank 1 is made of copper, nickel, tin, platinum, cobalt or the like, the size of which corresponds to the plating tank 1. Thickness of the metal plate 2 is about 2 mm, considering the wear during plating. The upper end of the metal plate 2 for anode is connected to the positive terminal 6*b* of the rectifier 6 through the electric lead 9.

Figure 2:
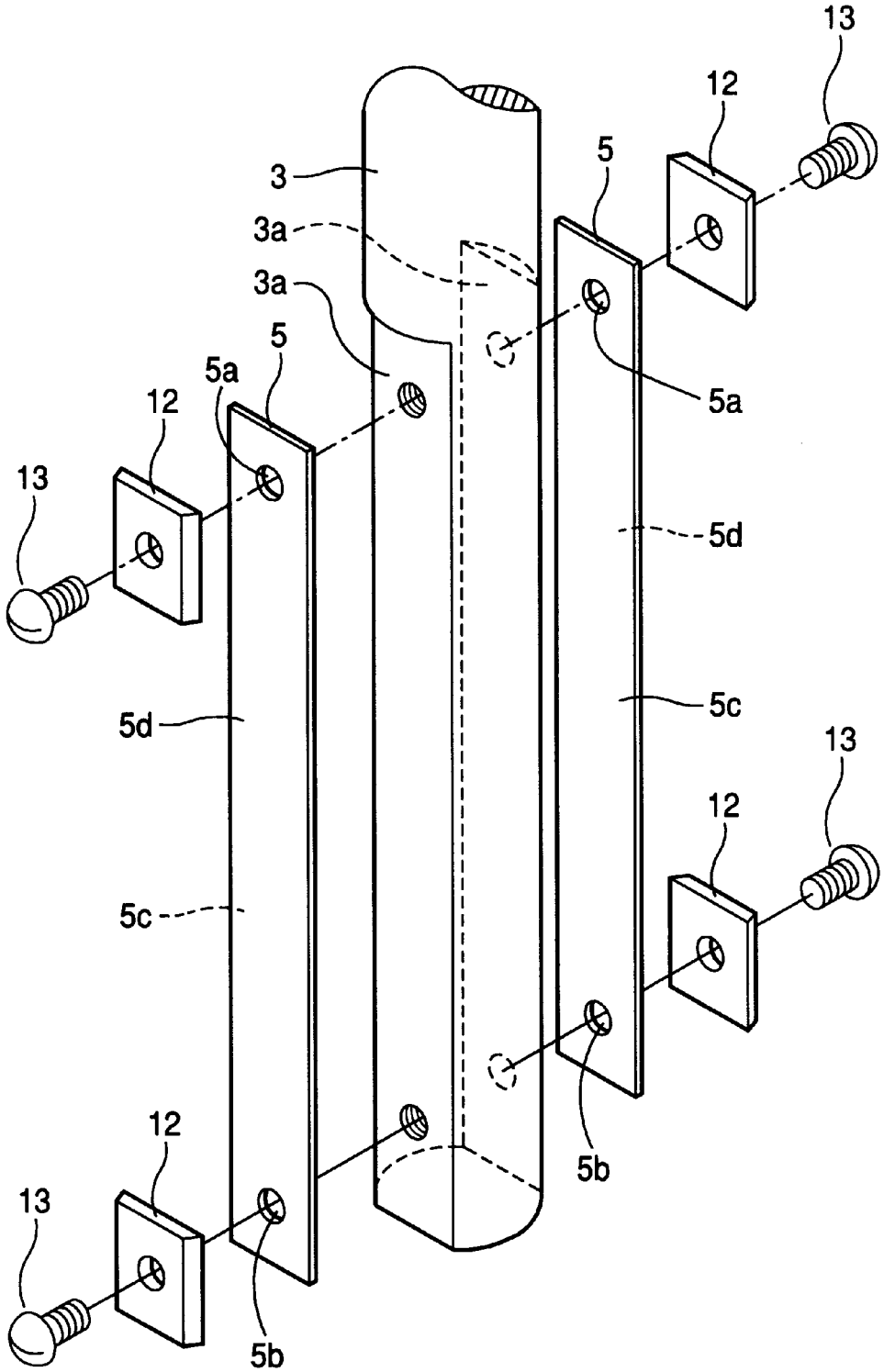
FIG. 2 is an enlarged sectional view showing mounting of metal plates for cathode on a metal rod for cathode used for the internal stress testing device.

The metal rod 3 for cathode is disposed within the plating tank 1 opposite to the metal plate 2 for anode. The metal rod 3 is made of a conductive material such as copper, brass or the like, and the diameter thereof is about 10 mm. The upper end of the metal rod 3 for cathode is held by the motor 4 such that the metal rod 3 is rotated by the motor 4. The upper end of the metal rod 3 is connected to the electric lead 7 through a slip ring or the like such as a carbon brush, and the electric lead 7 is further connected to the negative terminal 6*a* of the rectifier 6. As shown in FIG. 2, the lower end of the metal rod 3 is provided with two opposing planer portions 3*a*, 3*a* for mounting thereon two metal plates 5, 5 for cathode.

As shown in FIG. 2, the metal plate 5 for cathode is a thin metal plate made of copper, brass, iron, stainless, aluminum or the like material, The metal plate 5 is provided at both ends with a mounting hole 5*a* or 5*b* such that an insulated screw 13 though an insulated washer 12 is screwed into the mounting hole 5*a* or 5*b*. Since each metal plate 5 for cathode is mounted on the planer portion 3*a* of the metal rod 3 for cathode by the two insulated screws 13 and the corresponding insulated washers 12, 12, plating deposits are not made on the reverse side of the metal plate 5 for cathode as well as on the insulated screws 13 and the insulated washers 12, 12.

As mentioned above, each metal plate 5 for cathode is mounted on the metal rod 3 for cathode in such manner that the reverse side 5*c* thereof tightly contacts on the planer portion 3*a* of the metal rod 3, therefore a plating deposit is made merely on the top surface 5*d* of the metal plate 5.

The metal plates 5, 5 with a plating deposit are detached from the metal rod3 for cathode. Internal stress of the plating deposit is measured by a strip contractometer 20 shown in FIG. 3. Since the metal plate 5 for cathode is deflected due to internal stress of the plating deposit, the internal stress ($\sigma$) of the plating deposit is measured by measuring the recovering force (F) to recover the deflection of the metal plate for cathode 5. The internal stress of the plating deposit is given by the following formula (2):

$$\sigma = \frac{2l}{b(t+d)} \cdot \frac{F}{d}$$

where, F: Recovering force (N)

b: Width of the metal plate 5 for cathode (mm)

t: Thickness of the metal plate 5 for cathode (mm)

l: Length of the metal plate 5 for cathode (mm)

d: Thickness of the plating deposit (mm)

The motor 4 for rotating the metal rod 3 for cathode is fixed to a supporting table (not shown). A joint 4*a* is provided at the end of the driving axis of the motor 4 so as to hold the upper end of the metal rod 3. Rotational speed of the motor 4 is variable between 0 to 2000 rpm, and when, for example, a metal rod of 10 mm diameter is used, a similar plating condition can be created to that of high speed electroplating at the maximum movement speed of 60 m/min. When a test is required for high speed electroplating with more increased movement speed, the diameter of the metal rod 3 may be increased, or a high speed motor otherwise accelerating gears may be employed.

A rectifier 6 for supplying the testing device A with electric power may be any conventional type having a rectifying circuit such as a diode bridge circuit or a smoothing circuit, and the capacity thereof is to some extent 0 to 20V of output voltage, and 0 to 30 A of output electric current.

Figure 3:
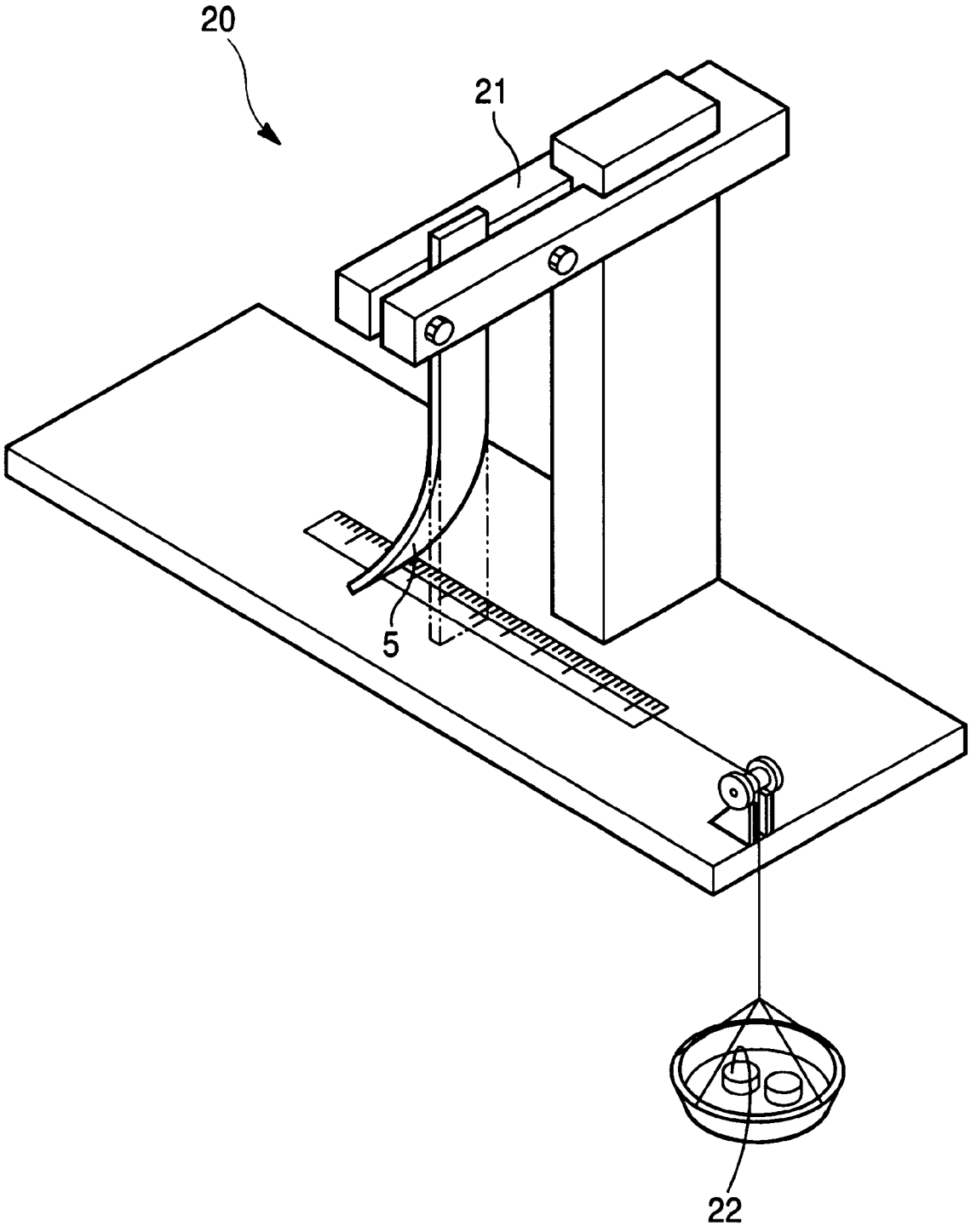
FIG. 3 is a perspective view showing a measuring device of the internal stress testing device shown in FIG. 1.

Referring to FIGS. 1 to 3, process of the internal stress test will be described. The metal plate 2 for anode is disposed within the plating tank 1 filled with a plating solution 14 to be tested. The metal plates 5, 5 for cathode as test pieces are mounted on the planer portions 3*a*, 3*a* of the metal rod 3 for cathode with the use of the insulated washers 12, 12 . . . and the corresponding insulated screws 13, 13 . . . . The metal rod 3 for cathode is connected to the joint 4*a* of the motor 4 so as to be positioned opposite to the metal plate 2 for anode. The slip ring 11 is set on the metal rod 3, and the electric lead 7 is connected to the negative terminal 6*a* of the rectifier 6. The electric lead 9 of the metal plate 2 for anode is also connected to the positive terminal 6*b* of the rectifier 6.

Prior to driving the internal stress testing device A, the rotational speed of the motor 4, and the voltage and the electric current of the rectifier 6 are adjusted depending on the plating to be tested. When turning on the switch, the testing device A is actuated.

After a certain period of time (approximately 10 to 60 seconds), the switch of the internal stress testing device A is off. The metal rod 3 for cathode is withdrawn from the plating tank 1 and detached from the motor 4. The metal plates 5, 5 for cathode are then detached from the metal rod 3.

As shown in FIG. 3, the metal plate for cathode 5 is fixed to a test piece holder 21 of a conventional internal stress meter 20, and the recovering force (F) of the metal plate 5 for cathode, which is required to make the deflected metal plate 5 restraightened is measured with the use of weights 22.

The metal plate 5 is then detached from the measuring device 20. Thickness of the plating deposit (d) on the metal plate 5 is measured according to the method defined in JIS H 8501.

The internal stress ($\sigma$) of the plating deposit is obtained from the formula (2) by including the recovering force (F) and the thickness of the plating deposit (d) as well as the width (b), length (l) and thickness (t) of the metal plate 5 for cathode which previously measured.

The above-mentioned internal stress testing device A for high speed electroplating enables to make similar plating deposits on the metal plates 5, 5 for cathode to those made by the high speed electroplating method since the metal rod 3 for cathode and the metal plates 5, 5 mounted thereon are rotated at a certain speed.

Figure 4:
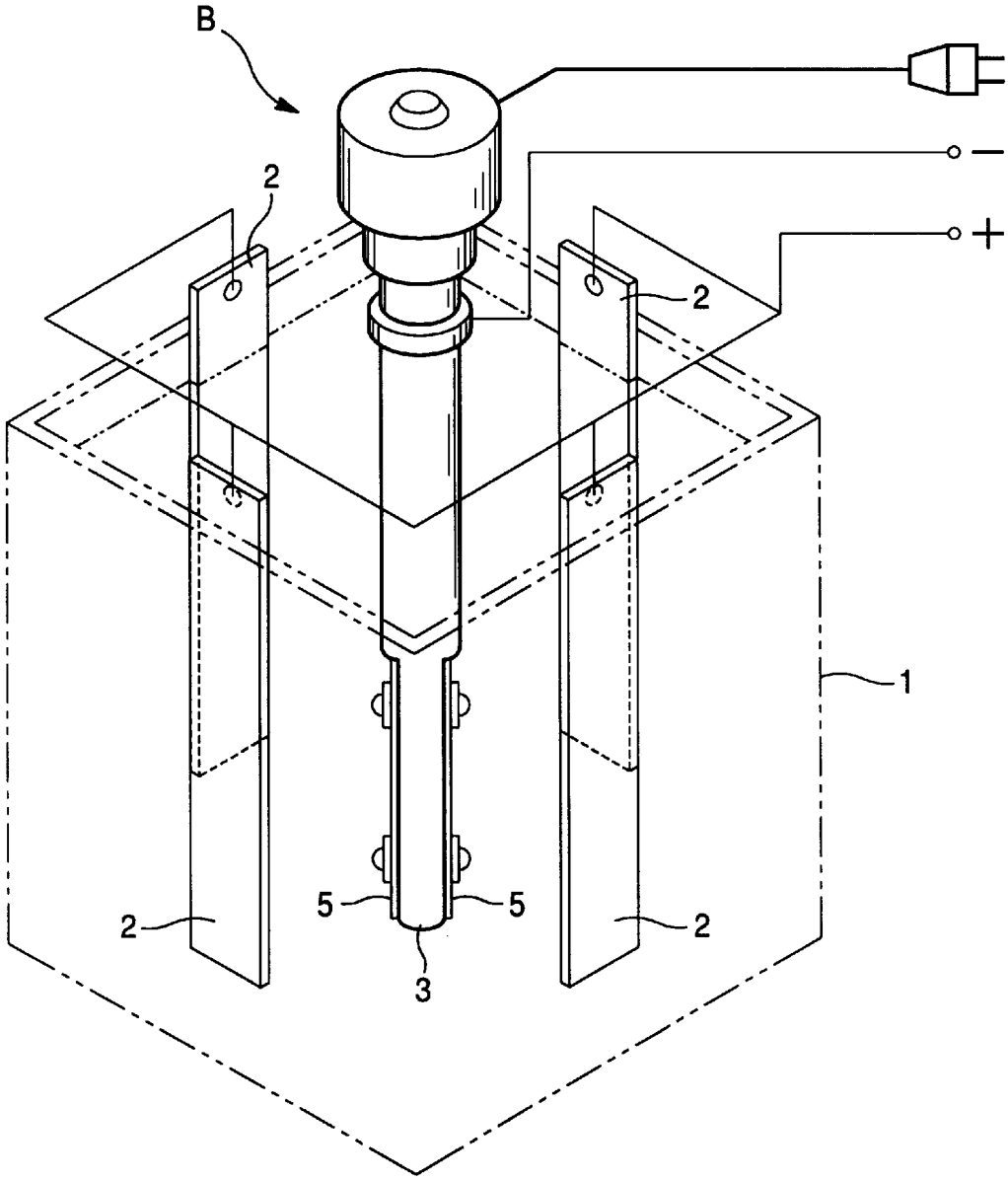
FIG. 4 is a perspective view showing a modified embodiment of the internal stress testing device for high speed electroplating according to the present invention.

Referring to FIG. 4, a modified embodiment of the internal stress testing device will be described. The internal stress testing device B comprises the metal rod 3 for cathode to which the metal plates 5, 5 for cathode are mounted, and four metal plates 2, 2 . . . for anode symmetrically disposed around the metal rod 3 to the front-and-end and the right-and-left directions, respectively. In such internal stress testing device B, the distance between each metal plate 5 for cathode and each metal plate 2 for anode is kept constant regardless of the positions of the metal plate 5 upon rotation, leading to constant thickness of the plating deposits on the respective metal plates 5, 5 for cathode. With such arrangement of the metal plates 2, 2 . . . for anode, the internal stress testing device B can provide plating deposits, which are similar to the plating deposits actually made by the high speed electroplating method.

The number of the metal plates 2,2 . . . provided with the internal stress testing device B for high speed electroplating can vary as long as the metal plates 2, 2 . . . are positioned around the metal rod 3. It can be said that the more the metal plates 2, 2 . . . , the greater will be the precision of the plating deposits made on the metal plates 5,5 for cathode compared to the plating deposit made by the high speed electroplating method.

Figure 5:
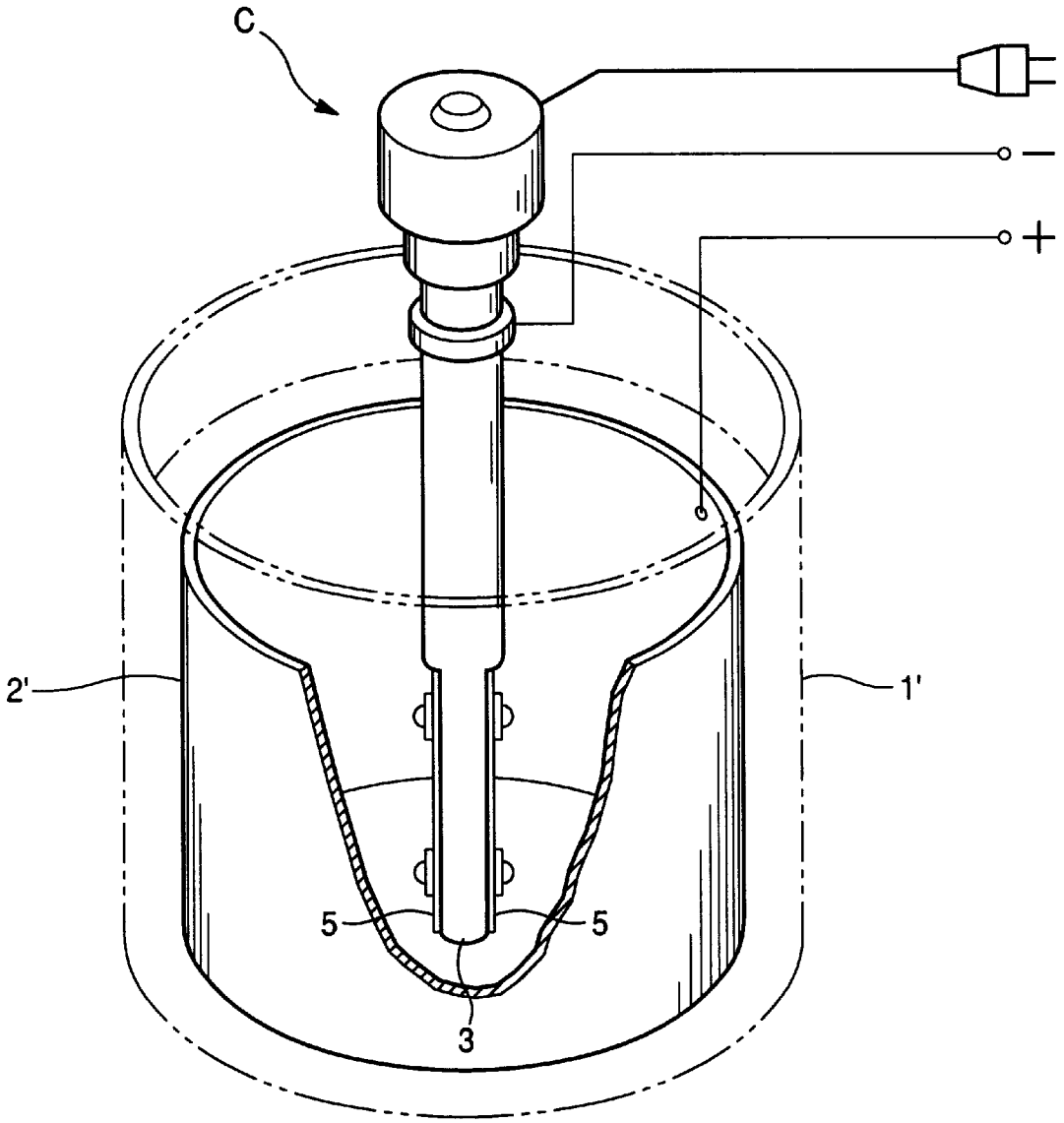
FIG. 5 is a perspective view showing another modified embodiment of the internal stress testing device for high speed electroplating according to the present invention.
Figure 6:
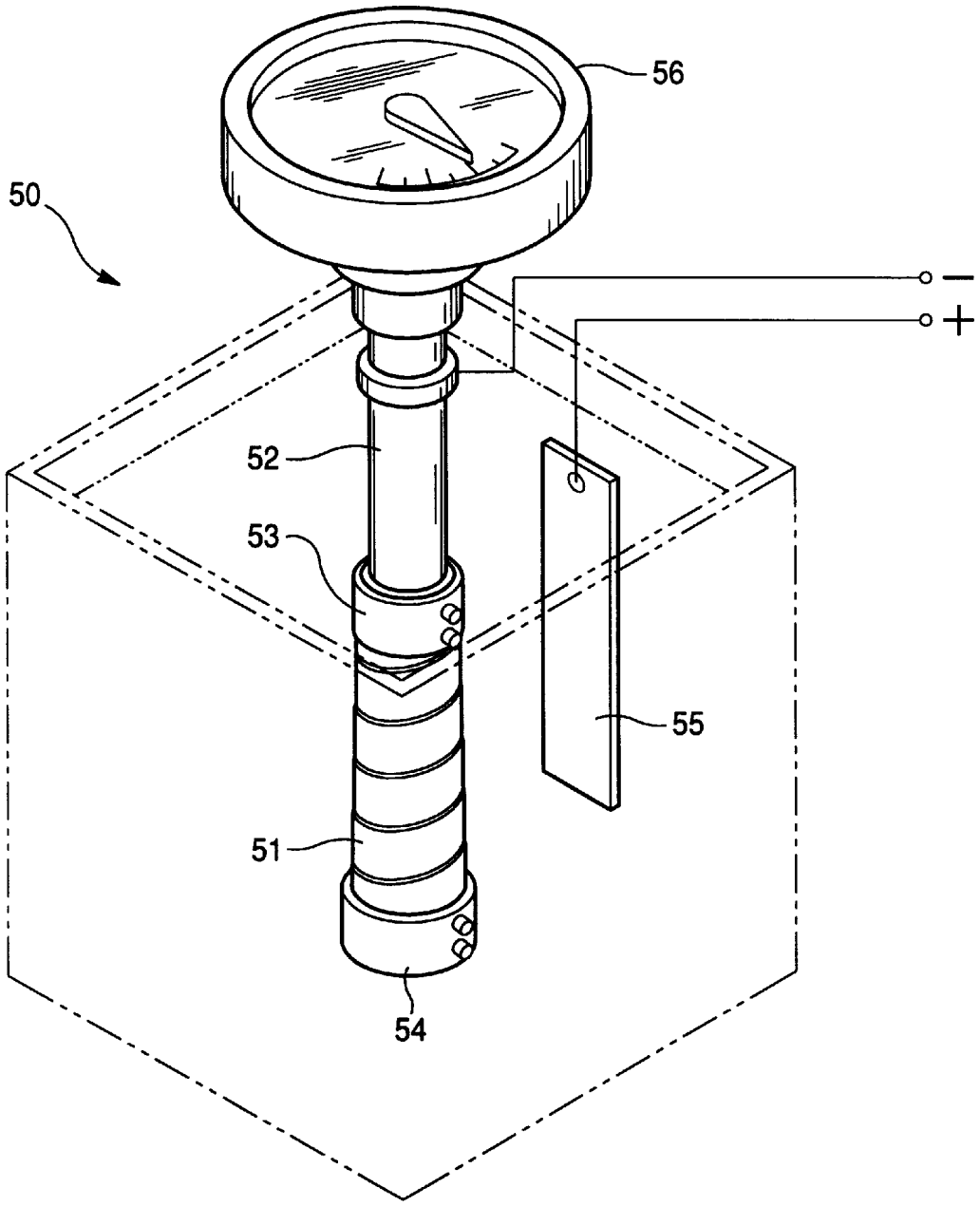
Fig. 6 Prior Art
FIG. 6 is a perspective view showing a conventional internal stress testing device utilizing a spiral contractometer.

Referring to FIG. 5, another modified embodiment of the internal stress testing device will be described. The internal stress testing device C comprises a cylindrical plating tank 1', and the metal plate 2' for anode extending along the inner periphery of the plating tank 1' around the metal rod 3 for cathode. In such internal stress testing device C, since the metal rod 3 is positioned at the center and the distance between each metal plate 5 for cathode and the metal plate 2' for anode is always kept constant regardless of the position of the metal plate 5 upon rotation, leading to constant thickness of the plating deposits on the respective metal plates 5, 5 for cathode. With such arrangement of the metal plate 2' for anode, plating deposits on the metal plates 5, 5 gradually increase the thickness, and thereby ideal plating deposits can be made. Accordingly, the internal stress testing device C can provide plating deposits of great precision.

As mentioned above, an internal stress testing device according to the present invention is relatively simple in its construction and enables to make similar plating deposits to those made by the high speed electroplating method.

Further, if a plurality of metal plates for anode are disposed symmetrically around the metal rod for cathode within the plating tank having a square transverse section, or if the plating tank has a circular transverse section and the metal plate for anode extends along the inner periphery of the tank, relative positions between the metal plate(s) for anode and the metal rod for cathode are kept constant. This leads to constant plating deposits on the metal plates for cathode, and hence plating deposits of greater precision as made by the high speed electroplating method.

Moreover, since the metal plates for cathode are mounted on the planer portions of the metal rod for cathode by the two insulated screws and the corresponding insulated washers, plating deposits are made merely on one side of the metal plates for cathode. This is advantageous for the internal stress test of greater precision.

What is claimed is:

1. An internal stress testing device for high speed electroplating, which comprises:

a tank to be filled with a plating solution;

a metal plate for anode disposed within the tank;

a metal rod for cathode disposed within the tank and rotatably held by a motor at a position opposite to the metal plate for anode;

a metal plate for cathode in the shape of a thin plate mounted on the metal rod; and a DC power supply connected to the metal plate for anode and the metal rod for cathode.

2. An internal stress testing device for high speed electroplating according to claim 1, wherein said tank has a square transverse section, and said metal plate for anode and said metal rod for cathode are disposed in pair.

3. An internal stress testing device for high speed electroplating according to claim 1, wherein said tank has a square transverse section, and a plurality of metal plates for anode are disposed symmetrically around the metal rod for cathode.

4. An internal stress testing device for high speed electroplating according to claim 1, wherein said tank has a circular transverse section, and said metal plate for anode extends along the inner periphery of the tank.

5. An internal stress testing device for high speed electroplating according to claim 4, wherein said metal plate for cathode is mounted on the plane surface at the lower end of the metal rod for cathode.

* * * * *